US006826856B1

(12) United States Patent
McCabe

(10) Patent No.: US 6,826,856 B1
(45) Date of Patent: Dec. 7, 2004

(54) LAUNDRY ARTICLE SPREADER APPARATUS AND METHOD

(75) Inventor: Stanley G. McCabe, Lubbock, TX (US)

(73) Assignee: Finishtech Ltd., Morton Grove, IL (US)

( * ) Notice: Subject to any disclaimer, the term of this patent is extended or adjusted under 35 U.S.C. 154(b) by 0 days.

(21) Appl. No.: 10/635,866

(22) Filed: Aug. 6, 2003

(51) Int. Cl.[7] ..... D06F 67/04
(52) U.S. Cl. ..... 38/143
(58) Field of Search ..... 38/143; 271/3.15, 271/3.18, 109, 225, 226, 265.01, 314, 82; 198/571, 678.1, 803.3; 414/744.2, 621

(56) References Cited

U.S. PATENT DOCUMENTS

| | | | | |
|---|---|---|---|---|
| 3,092,263 | A | 6/1963 | Beaudry et al. | |
| 3,092,271 | A | 6/1963 | Beaudry et al. | |
| 3,168,307 | A | 2/1965 | Walton et al. | |
| 3,421,756 | A | 1/1969 | Weir | |
| 3,429,063 | A | 2/1969 | Myers | |
| 3,553,863 | A | 1/1971 | Sjostrom | |
| 3,696,942 | A | 10/1972 | Kitchener et al. | |
| 3,911,604 | A | 10/1975 | Sjostrom | |
| 4,053,967 | A | 10/1977 | Mair | |
| 4,106,227 | A | 8/1978 | Allen et al. | |
| 4,299,521 | A | 11/1981 | Jensen | |
| RE31,453 | E | 12/1983 | Olsen et al. | |
| 4,774,505 | A | 9/1988 | Ueda et al. | |
| 4,943,198 | A | 7/1990 | McCabe | |
| 4,979,868 | A | 12/1990 | Ueda et al. | |
| 5,168,645 | A | 12/1992 | Robin et al. | |
| 5,169,282 | A | 12/1992 | Ueda et al. | |
| 5,172,502 | A | 12/1992 | Kober | |
| 5,300,007 | A | 4/1994 | Kober | |
| 5,333,402 | A | 8/1994 | Weir | |
| 5,416,992 | A | 5/1995 | Ueda et al. | |
| 5,440,810 | A | 8/1995 | Borucki et al. | |
| 5,515,627 | A | 5/1996 | McCabe | |
| 5,546,684 | A | * 8/1996 | Jensen | 38/143 |
| 5,595,467 | A | 1/1997 | Jensen | |
| 6,141,893 | A | 11/2000 | McCabe | |
| 6,477,797 | B1 | 11/2002 | Takahashi et al. | |
| 6,584,711 | B1 | 7/2003 | Nakamura | |

FOREIGN PATENT DOCUMENTS

| | | |
|---|---|---|
| GB | 2219313 | * 12/1989 |

* cited by examiner

*Primary Examiner*—Ismael Izaguirre
(74) *Attorney, Agent, or Firm*—Brinks Hofer Gilson & Lione

(57) ABSTRACT

A towel spreader is provided. A trailing corner is clamped to isolate an edge of a towel where the edge is either along a fold in a towel or along an outer extremity of the towel. The towel is then flattened in a single or two layers using motion and gravity while being held along the identified edge. The same or a different trailing corner is then rotated such that a back outer extremity edge of the towel is perpendicular with a direction of movement of a conveyor. By clamping the back edge while continuing to move a downstream conveyor and blow air on the towel, the towel is flattened out. The spread towel is then passed downstream for further processing, such as folding.

33 Claims, 4 Drawing Sheets

LAUNDRY ARTICLE SPREADER APPARATUS AND METHOD

BACKGROUND

The present invention relates to automated laundry spreaders. In particular, a spreader for laying articles of laundry out flat is provided.

Many processes in laundries are automated. For example, machines in hotels spread out, iron and fold sheets without operator intervention. To begin the automated process, the operator identifies either corners or an edge of the sheet and places the corners or edge into the first machine. Since sheets have large dimensions with thin fabric, the sheets are often tangled together, necessitating either an automated separator machine or an operator for locating the edges or corners.

Since towels are smaller and thicker, towels may be less likely tangled after removal from a washing or drying machine. However in typical towel processing, an operator still grabs individual towels and places them on folding machines. Where possible, automated processes may save money over a period of time.

Machines for automatically grabbing towels from a load of towels and spreading the towels have been attempted, but find little commercial success. Typically, these machines attempt to isolate diagonal corners and then opposite corners. Such isolation can be difficult and inconsistent when implemented with a machine.

BRIEF SUMMARY

The present invention is defined by the following claims, and nothing in this section should be taken as a limitation on those claims. By way of introduction, the preferred embodiments described below include apparatuses and methods for spreading a towel from a load of towels. A trailing corner is clamped to isolate an edge of a towel where the edge is either along a fold in a towel or along an outer extremity of the towel. The towel is then flattened in a single or two layers using motion and gravity while being held along the identified edge. The same or a different trailing corner is then rotated such that a back outer extremity edge of the towel is perpendicular with a direction of movement of a conveyor. By clamping the back edge while continuing to move a downstream conveyor and blow air on the towel, the towel is flattened out. The spread towel is then passed downstream for further processing, such as folding. Each of the individual stages described above may be used in a different apparatus or used with or without other stages described above. Any of the overall structure, individual stages or combinations of individual stages in the embodiment below may provide advantages and be claimed independently herein.

In a first aspect, an apparatus for spreading a towel from a load of towels is provided. A pivot joint connects with a clamp and a frame. The clamp is operable to grab the towel. A drive is connected with the clamp so as to drive the clamp downward about the pivot joint. At least a portion of the towel is forced away from the clamp in response to the clamp being driven downward.

In a second aspect, a method for spreading a towel from a load of towels is provided. The towel is clamped. The towel is then rotated about an axis spaced away from the towel. The rotation is at least in part downward. The towel flattens in response to the rotation.

In a third aspect, an apparatus for spreading a towel from a load of towels is provided. A downstream conveyor is spaced from an upstream conveyor by a slot. The slot is narrow such that the towel is able to rest on both the upstream and downstream conveyors at a same time. A clamp is positioned to move in the slot between the two conveyors.

In a fourth aspect, a method for spreading a towel from a load of towels is provided. A towel is conveyed on two conveyors. An edge of the towel is clamped between the two conveyors. The clamped edge of the towel is moved closer to a side of the downstream conveyor such that another edge of the towel is positioned more perpendicular to the direction of travel of the downstream conveyor.

In a fifth aspect, an apparatus for spreading a towel for the load of towels is provided. At least two jaw points are positioned above an upstream conveyor. The jaw points are operable to press a first portion of a towel against the first conveyor. A blower is directed towards a second downstream conveyor. The downstream conveyor is operable to continue movement with a portion of the towel on the downstream conveyor while the first portion of the towel is held by the jaw points against the first conveyor. The blower is operable to direct air towards the towel while the downstream conveyor is moving and the jaw points are holding the towel at the upstream conveyor.

In a sixth aspect, a method for spreading a towel from a load of towels is provided. A towel is positioned on upstream and downstream conveyors. The towel is clamped on the upstream conveyor. The downstream conveyor continues to convey while the towel is clamped. The towel is also blown while the towel is Further aspects and advantages of the invention are disclosed below in conjunction with the preferred embodiments

BRIEF DESCRIPTION OF SEVERAL VIEWS OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

FIGS. 1–7 show various aspects of one embodiment. Various stages and aspects of the embodiment may be altered or changed based on now known or later developed devices and methods. The spreader isolates a towel from a load of towels and spreads the towel out flat for subsequent processing. For example, the towel is output to an automated towel folder, such as disclosed in U.S. Pat. No. 5,300,007, the disclosure of which is incorporated herein by reference. Alternatively, the spread towel is output to an operator or stacked for further use.

The towel spreader described herein is adapted for isolating and spreading square hand towels, including napkins. For example, terry cloth hand towel, other hand towels or cotton napkins around 8 to 18 inches on a side are processed. Larger towels or smaller towels may also be processed. In other embodiments, one or more of the stages described herein are used for processing rectangular towels, such as hand, bath and beach towels. Towels with thinner material, such as woven or knit pillowcases, pillow shams or other laundry articles may also be processed. Other articles of laundry, such as sheets or blankets, may also be spread using one, more or all of the stages described herein.

Figure 2:
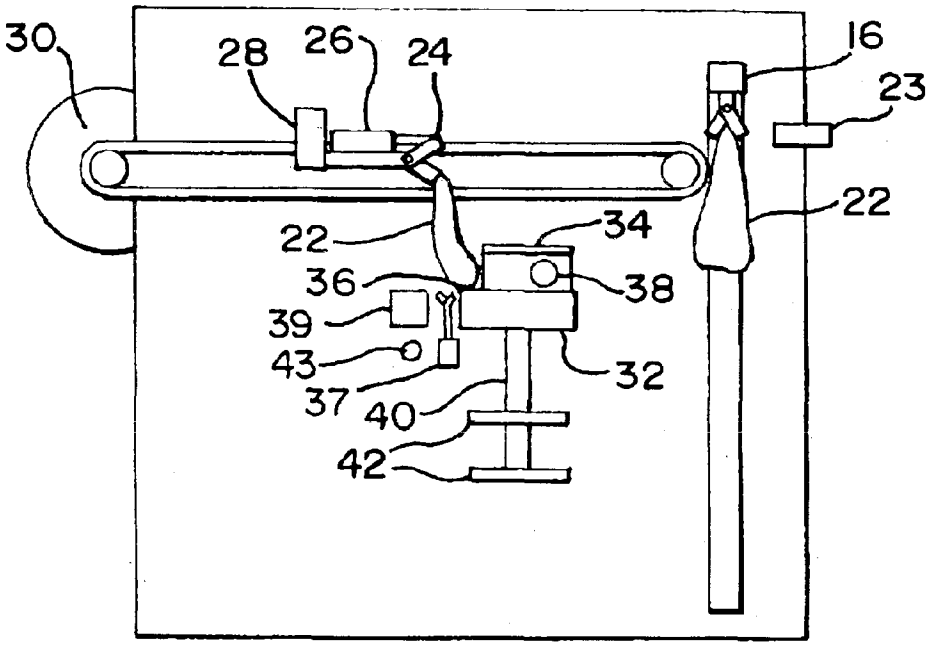
FIG. 2 is a side view of a cutaway portion of the initial stages of a towel spreader in one embodiment.
Figure 4:
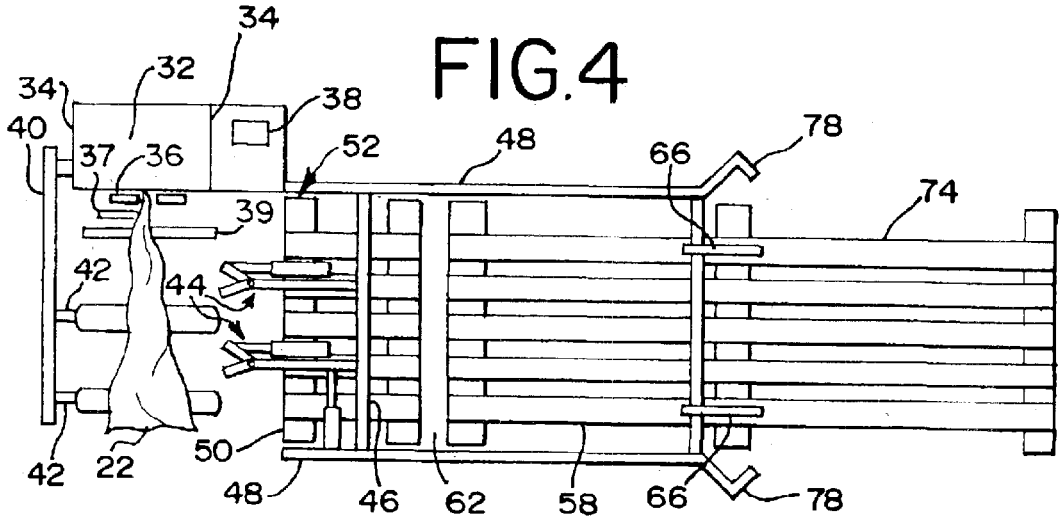
FIG. 4 is a top view of the portion of the towel spreaders shown in FIG. 3.
Figure 3:
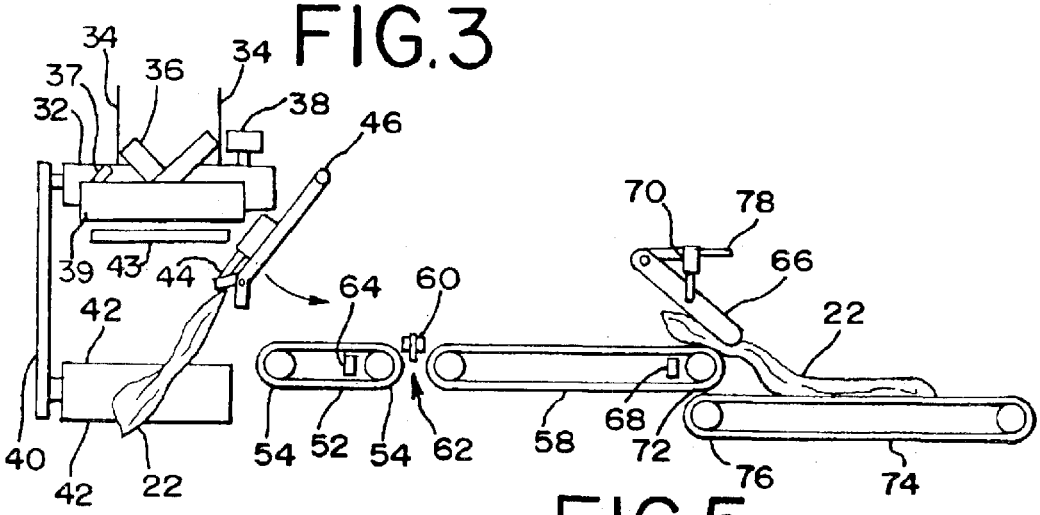
FIG. 3 is a cutaway front view of some of the same and subsequent stages of the towel spreader of FIG. 2.

FIGS. 1–7 show one apparatus positioned within a single frame structure. Different portions of the apparatus are shown in different views to illustrate the components and operation of various stages for spreading a towel. In one embodiment, the stages are built together within the frame work in as small a space as possible while providing sufficient volume for spreading towels. FIG. 2 shows an interior side wall and some related components. In one embodiment, FIG. 2 shows a left interior side wall. FIGS. 3 and 4 show side and top views of components adjacent to and extending away from the interior wall of FIG. 2. Various plates for safety and preventing operators from entanglement within the spreader are included, but not shown. Electrical, hydraulic and air pressure cables and hoses interconnect various components for controlling and operating spreading of the towel. These cables and hoses are configured and routed as is known in the art or later developed. One or more controllers, such as a processor, coordinate thc movement and operation of the various components.

Figure 1:
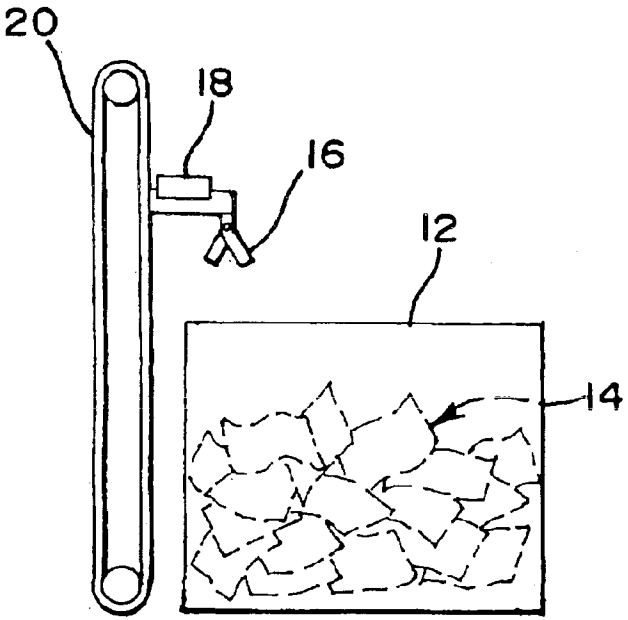
FIG. 1 is a front view of an initial clamp mechanism of a towel spreader in one embodiment.

FIG. 1 shows a bin 12 for holding a load of towels 14. The bin 12 is of various sizes or shapes. In one embodiment, the bin 12 tapers towards one location at the bottom of the bin 12. As towels are removed from the bin, remaining towels migrate towards the location for clamping. In alternative embodiments, conveyors, vibration, tilting mechanisms or other devices are provided for continually positioning towels near a clamping position. The bin 12 is positioned beneath the system in general such that any towels dropped throughout processing are placed back within the bin 12. Alternatively, the bin 12 is small enough such that dropped towels and other portions of the system will fall into a separate compartment.

A movable clamp 16 is a chuck, scissor clamp, two opposing plates, jaws, pinch roller, pinch plates, pinching belts or other structure operable to hold a towel. In one embodiment, the clamp 16 includes two metal plates separated by a space for one jaw and an opposing metal jaw operable to move between the two plates of the other jaw. The towel is clamped between the two jaws. Plastic, wood or other materials may be used.

The clamp 16 is actuated by a pneumatic cylinder 18. One or both jaws of the clamp 16 connect with the pneumatic cylinder 18 or a plurality of cylinders. In alternative embodiments, an electric servo, an air driven cylinder, hydraulic cylinder, a pneumatic actuator, extending screw device with an electric motor or other mechanism is provided for actuating the clamp.

The clamp 16 and the actuator 18 are connected to a drive structure 20. In one embodiment, the drive structure 20 is a pulley and motor with an endless belt or chain. For example, a timing belt with an inverter is used. The clamp 16 connects to one run of the endless chain to clamp objects in a downward direction. Using an electrical control and sensors, the drive structure 20 is operable to position the clamp 16 adjacent to or in the load of towels 14. The clamp 16 clamps one or more towels. The clamp 16 is sized to most likely select a single towel, such as by having jaws that extend only about an inch. The clamped towel and clamp 16 are moved away from the load of towels 14, such as upwards. FIG. 2 shows the clamp 16 at an upward position with the towel 22 hanging down. Timing on the timing chain of the drive mechanism 20 and/or electric eyes are used to detect that the towel 22 is positioned on the upper location as shown in FIG. 2. For example, the sensor 23 detects the presence of the towel 22 at the uppermost position or a position ready for the next stage of processing.

A horizontally moving clamp 24 and associated actuator 26 with the same or different structures as discussed above for clamp 16 and actuator 18 grabs the towel 22. The clamp 24 is connected to a drive mechanism 30 of the same or different structure as the drive mechanism 20 discussed above. The clamp 24 and actuator 26 connect with the drive mechanism 30 by a plate and bolts or other mechanism 28. In response to the sensor 23, the drive mechanism 30 positions the clamp 24 against the towel 22. Once positioned against the towel 22, the clamp 24 closes to grab the towel 22. In one embodiment, a sensor is provided to detect contact of the clamp 24 with the towel. In other embodiments, the clamp 24 is positioned to where a towel should be positioned. In response to the closing of clamp 24, the clamp 16 releases the towel. The clamp 24 grabs the towel just below the clamp 16 or at another location anywhere on the towel 22.

The drive mechanism 30 moves the clamp 24 and the towel 22 horizontally away from the clamp 16. Movement up or down or in any other direction may be provided. The towel 22 hangs by force of gravity from the clamp 24 until coming in contact with a plate 32. In one embodiment, the plate 32 is a flat metal plate, but a plate with a rough surface, irregular shape or curved surface of any material may be used. Two guides 34 are positioned on each side of the plate 32 so that the towel 22 is dragged between the guides 34 over the plate 32. The plate 32 and guides 34 are sized and positioned to position the towel 22 being dragged by the clamp 24 in the jaws of an additional clamp 36 at the side or end of the plate 32.

The clamp 36 is of a same or different structure as described above for the clamp 16. In one embodiment, the clamp 36 has one jaw movable by pneumatic activation and another jaw made of a couple plates separated by a space sufficient to accept the opposing jaw. In one embodiment for increased clamping speed, both jaws connect with separate actuators (e.g., pneumatic cylinders) for coordinated movement to clamp the towel 22. The clamp 36 is sized and positioned so that as the towel 22 exits off the plate 32, the towel 22 is between the jaws of the clamp 36.

As shown in FIGS. 2–4, a sensor 38, such as a light beam sensor for transmitting a beam of light and receiving any reflection, is positioned to detect the towel 28 through a hole in the guide 34. A hole may be provided in both guides 34 to better distinguish between the presence and absence of the towel 22. As the towel 22 is dragged across the plate 32 and through the open clamp 36, the light sensor 38 detects a trailing or end portion of the towel 22. Since the towel is usually gripped at a position other than the center of the towel by the clamp 24, the trailing portion of the towel 22 is a corner of the towel. Upon sensing the end of the towel, the clamp 36 is activated to close, grabbing the trailing corner of the towel 22. As or after the clamp 36 closes, the clamp 24 is opened. As a result, the towel 22 hangs from a corner from the clamp 36 on a front side of the plate 32.

Figure 8A:
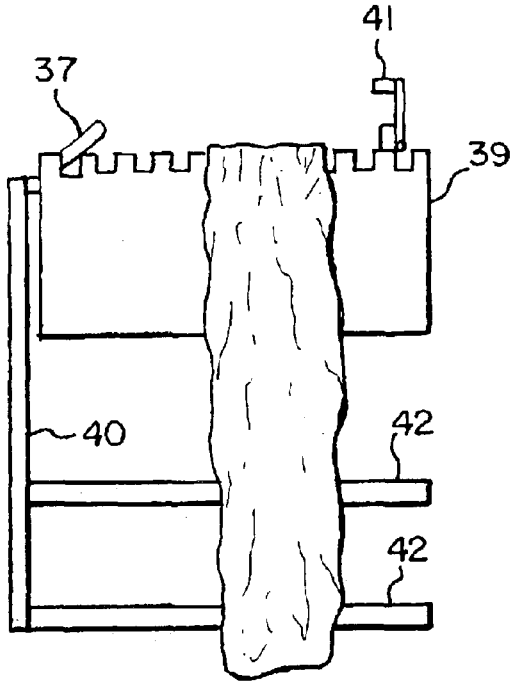
FIGS. 8A and 8B are front views of a spreading clamp structure of one embodiment.
Figure 8B:
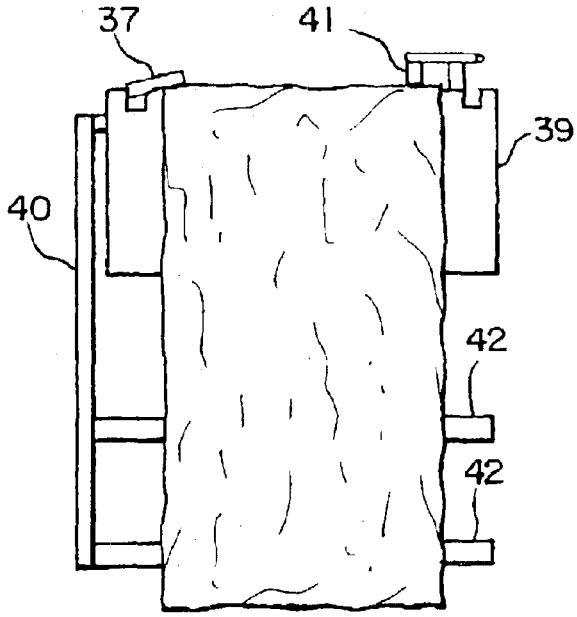
Figure 9:
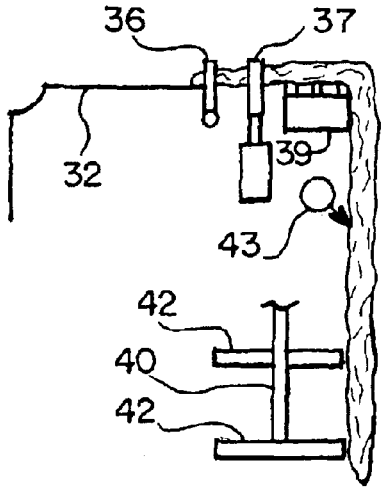
FIG. 9 is a side view of the spreading clamp structure of FIGS. 8A and 8B.

In one embodiment shown in FIGS. 8A, 8B and 9, a further spreader is provided. A belt or plate 39 with a plurality of cleats, a rough surface, bristles, or other tacky surface is positioned beyond the claim 36. When the clamp 24 is opened, the towel 22 drapes over the plate 39. About 2 to 4 inches of the towel is positioned from the clamp 36 to the plate 39 in a horizontal or other angle from horizontal position. For smaller towels, the plate 39 is positioned more below and/or closer to the clamp 36 to provide more vertical drop. The remainder of the towel 22 hangs from the plate 39 due to gravity. Alternatively, the towel 36 is allowed to hang vertically from the clamp 36 without contacting the plate 39.

An additional clamp 37 of the same or different structures and actuators as discussed for thc clamp 16 and actuator 18 is provided between the plate 39 and the clamp 36. The additional clamp 37 slides, such as on a rodless cylinder, or rotates by a rotary actuator to grab the towel 22 adjacent to the clamp 36. For example, the clamp 37 clamps the towel within about 2 inches from the clamp 36 or the corner of the towel 22, but other distances may be used.

At a same time as the clamp 37 moves to and grabs the towel 22, a pressure point 41 is rotated with a small pneumatic cylinder, rotary cylinder or other device to apply pressure to the towel 22 against the plate 39. The pressure point 41 includes a rubber, plastic, rough surface or other material for slightly gripping the towel 22. The force of the pressure point 41 applied to the towel 22 is small, such as by providing a minimal or small amount of air pressure to the pneumatic cylinder. As the clamp 37 pulls the gripped towel horizontally over the plate 39, the cleats of the plate 39 and the pressure point 41 resist but do not prevent the movement of the towel 22, resulting in wrinkles and folds being pulled out. Also as the claim 37 clamps the towel 22 or pulls the towel 22, the clamp 36 releases the towel 22. As shown in FIG. 8A, the towel originally hangs from the plate 39 in a bunched position. After the clamp 37 drags part of the towel 22 over the plate 39 and beneath the pressure point 41, the towel 22 is more spread out as shown in FIG. 8B. Wrinkles and folds, at least in part, are removed from the towel 22 making the clamps 44 more likely to clamp an outer, actual edge of the towel. While the plate 39 and pressure point 41 are stationary in one embodiment, the plate 39 and pressure point 41 may move in another embodiment. For example, the plate 39 and pressure point 41 are moved in a direction opposite of the clamp 37 to assist in removing wrinkles and folds.

As shown in FIG. 9, an air nozzle or bar 43 with a plurality of holes or nozzles is provided beneath the plate 39. The air bar 43 is connected to a source of pressurized air and directs the air against the towel 22 at a downward angle. The force of the air tends to open folds in the towel 22. The air is directed at the towel 22 during or after the clamping and movement of the claim 37. In other embodiments, air is applied from other directions, such as by an air bar positioned above the plate 39.

A lift 40 is positioned below the plate 32, clamp 36, plate 39 and clamp 37. The lift 40 includes two plates or bars 42 on one end and an electric motor driven pivot point on another end. Pneumatic, chain, gear, air or other drive mechanisms may be provided. In one embodiment, the plates 42 are perpendicular to an arm of the lift 40. The plates 42 include fibers or bristles for preventing the towel 22 from sliding. In alternative embodiments, metal, rubber or other materials are provided. As an alternative to the plates 42, a single plate extends along the lift 40 or perpendicular to the lift arm may be used. As yet another alternative, a clamp is positioned on the lift 40 with or without plates 42. The clamp grabs the towel and holds the towel while the lift moves the towel into position.

Figure 5:
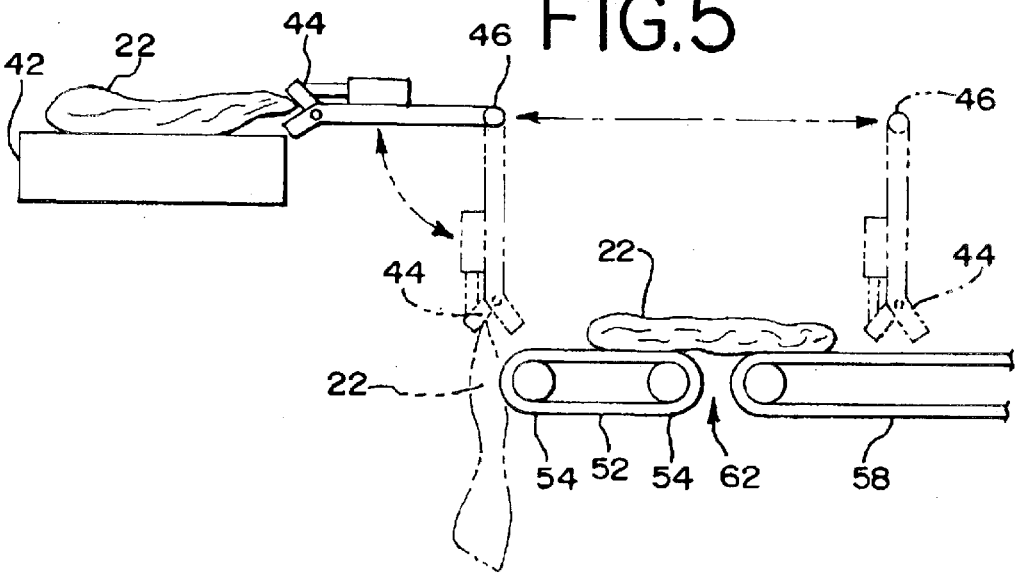
FIG. 5 is a side view of a rotatable and movable clamp shown in FIG. 3 and 4.

The lift 40 begins in a downward position, such as the vertical position shown in FIGS. 2 and 3. In response to the completed spreading action by the clamp 37, the lift 40 is rotated against the towel 22 to lift the towel 22 to a substantially horizontal position as shown in FIGS. 4 and 5. As shown in FIG. 4, one corner of the towel 22 is held in the clamp 37 and/or draped on the plate 39 and another end or portion of the towel 22 is spaced from the plate 39 or clamp 36. A minor or major portion of the towel 22 may hang down vertically from the end of the lift 40. By lifting the towel 22 from a vertical position hanging down from the plate 39 to a horizontal position, the lift 40 positions the towel 22 adjacent to a pair of clamps 44.

The clamps 44 are of the same or different structure with the same or different actuators as discussed for the clamp 16 and actuator 18. While two clamps arc shown, 1, 3, or other numbers of clamps may be used. Both clamps 44 connect with a rotatable bar or beam 46. The bar 46 is connected at a pivot joint to two runners 48 connected with the frame. The pivot joint includes ball bearings and gearing connected with a drive. In alternative embodiments, the clamps 44 each include separate pivot mechanisms allowing rotation of the clamps 44 about a stationary bar 46.

The drive is an electric motor, belt, pneumatic rotary actuator, air driven cylinder or other now known or later developed device for rotating the clamps 44 and bar 46 about the pivot joint. The pivot point and drive are configured to allow rotation of between 70 and 135 degrees. For example, rotation of 90 degrees from a horizontal to a vertical position is provided. Plates, rubber stoppers, other stoppers, pneumatic cylinders or other devices may be used for limiting the rotation of the clamps 44 about the pivot joint. Alternatively, the operation of the drive is used to limit the rotation of the clamps 44, such as a pneumatic rotary actuator providing about 90 of rotation.

The clamps 44 arc positioned against the towel 22 as the towel is in the clamp 36 and rests on the lift 40. For example, the pivot joint and bar 46 are mounted on a rack and pinion along the runners 48. As shown in FIG. 5, the bar 46 and clamps 44 are movable in a horizontal position towards and away from the towel 42 and the lift 40. By rotating the clamps 44 to a horizontal position and moving the clamps 44 towards the towel 22, the clamps contact the towel 22. An electric eye or other detector may be used for determining when the clamps 44 are positioned against the towel 22. Alternatively, the clamps 44 are positioned at a given location under the assumption that the towel 22 is positioned at that location by the lift 40 and clamp 36.

As shown in FIG. 4, one of the clamps 44 is positioned to grab the towel 22 between the two plates 42 of the lift 40. In alternative embodiments, the clamp 44 grabs the towel on the other side of either of the plates 42 or from a notch in a plate. The other clamp 44 grabs the towel between the plates 42 and the clamp 36. In one embodiment, the clamp 44 closest to the clamp 36 (inner clamp 44) is spaced from the clamp 36, such as by a few inches or about ¼ of the length of a typical towel. Alternatively, the clamp 44 is closer to or further from the clamp 36. The clamps 44 clamp random locations on the towel. The random locations correspond to either a true or exterior edge of the towel or an edge formed by the towel being folded over. The towel 22 is clamped by the clamps 44 where both the clamp 44 and the towel 22 are in a substantially horizontal position. Substantially is used herein to account for manufacturing tolerances, drooping of the towel 22, or angles designed to be within 45 degrees of horizontal. Greater angles may be provided in alternative embodiments.

After the clamps 44 grab the towel 22, the lift 44 is rotated back to a position below the plate 32 and clamp 36. The clamp 36 also releases the corner of the towel 22. The clamps 44 and the clamped towel 22 are rotated about the axis of the pivot joint and bar 46. The rotation is downwards as shown in FIG. 5. Since the clamps 44 are spaced from the bar 46, the towel is rotated about an axis spaced away from the towel 22. As a result, gravity and the rotation extend the towel outward in a more flat position as shown in FIGS. 3 and 5. By rotating the lift 40 away from the towel 32, the towel 22 is allowed to extend out flat without interference from other objects as the towel 22 is rotated by the clamps 44. As a result, at least a portion of the towel is forced away from the clamps 44. The rotation and extension flattens out the towel away from the clamps 44. The swinging helps stretch the towel, removing folds and wrinkles other than any fold clamped by the clamps 44.

As shown in FIG. 4, an actuator 50 is connected with the outermost clamp 44. The actuator 50 is a small pneumatic cylinder, air driven cylinder, servo driven or other now known or later developed device for moving the outer clamp 44. Before, during or after rotation of the clamp from the horizontal to the vertical positions, the actuator 50 causes the outward clamp 44 to move away from the inner clamp 44. The towel 22 is stretched between the clamps 44. For grabbing a next towel 22, the actuator 50 positions the outer clamp 44 closer to the inner clamp 44. The outer clamp 44 is connected by hinge to the bar 46 to allow the stretching movement.

A conveyor 52 is positioned below the pivot joint 46. The conveyor 52 is a short conveyor, such as associated with less than half, less than a full or more length of the towel 22. The conveyor 52 includes at least two rollers 54 with one or more belts extending between each roller, such as five straps of fabric, rubber or other material. The conveyor 52 includes a platform beneath the straps in between the rollers 54 in one embodiment, but embodiments may be provided without a platform. The conveyor 52 is driven by a gear, belt or chain connected from a motor to one or both of the pulleys 54. The conveyor 52 is positioned below the pivot joint and bar 46 such that the clamp 44 in thc vertical position is above one of the rollers 54. The conveyor 52 may be spaced away from or further underneath the clamps 44. As shown in FIGS. 3 and 5, a portion of the towel 22 extends down below the conveyor 52 and another portion of the towel 22 and the clamps 44 are above the conveyor. In alternative embodiments, the conveyor 52 is long enough such that as the clamps 44 rotate, the towel contacts the top of the conveyor 52 without extending below the conveyor 52.

As shown in FIG. 5, the pivot joint and bar 46 as well as the clamps 44 are moved horizontally over the conveyor 52 in the runners 48. As a result, the towel 22 is dragged and positioned over at least part of the conveyor 52 and at least partly onto a subsequent conveyor 58. The clamp 44 is then opened, releasing the towel 22. Due to the rotation of the clamps 44 as well as the dragging of the towel 22 on the conveyor 52, the towel 22 is released and laid out on the conveyor 52 and/or 58 in a flat position with a minimal number of folds. The conveyor 52 is operated in a forward or reversed direction or held stationary while the towel 22 is dragged by the clamps 44. For example, reverse operation may help flatten the towel. Stationary operation may also assist in flattening the towel. Moving the conveyor forwards such that the upper run of the conveyor proceeds towards the downstream conveyor 58 may prevent the towel 52 from getting snagged.

The downstream conveyor 58 is of a same or different structure than the conveyor 52 discussed above. The downstream conveyor 58 is shown as longer than the conveyor 52, but may be shorter or a same length. The downstream conveyor 58 is spaced from the upstream conveyor 52 by a slot 62. The slot is narrow or has a width such that the towel is able to rest on both the upstream and downstream conveyors 52, 58 at a same time. In one embodiment, the slot 62 is about an inch to 2 inches wide, but may be wider or shorter. Since the clamps 44 release one end of the towel 22 on the conveyor 58, the towel 22 is less likely to fall through the slot. In alternative embodiments, air or other blowers are used with a difference in elevation to allow the towel 22 to convey from the upstream conveyor 52 to the downstream conveyor 58. As shown in the embodiment of FIGS. 3 and 5, the upper surfaces of the upstream conveyor 52 and downstream conveyor 58 are along a substantially same plane, but may be different planes. The conveyors 52 and 58 are aligned to convey the towel 22 in a same direction, such as by shown in the arrows on FIGS. 6 and 7. After the clamps 44 release the towel 22, both conveyors 52 and 58 arc activated to convey the towel 22 along an upper surface in the same direction. In alternative embodiments, the conveyor 52 conveys in a different direction, such as a perpendicular or angled direction relative to the conveyor 58.

Figure 6:
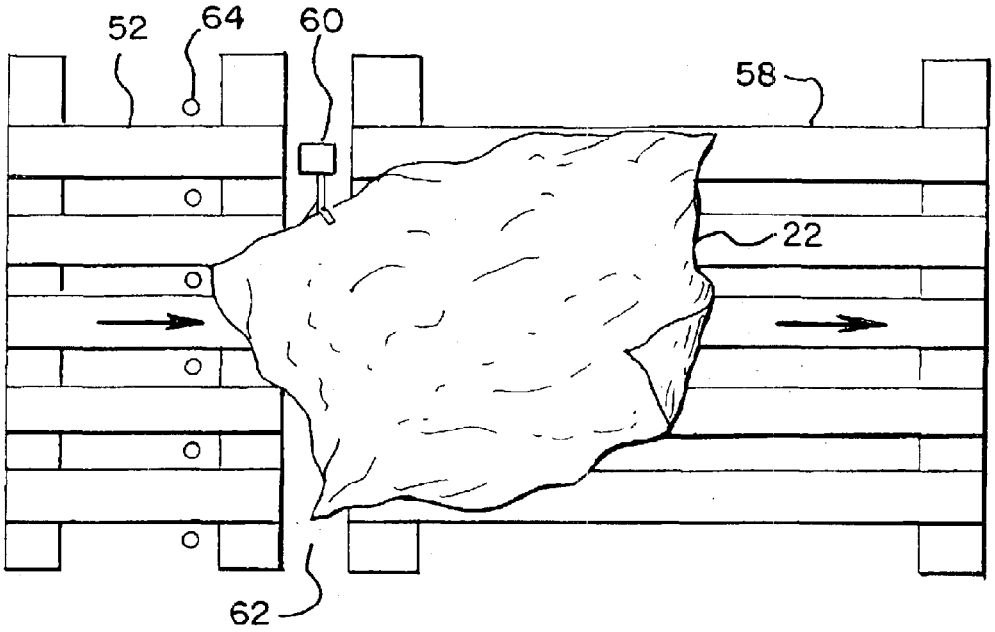
FIG. 6 is a top view of the conveyors shown in FIGS. 3–5 with the towel in a first position.

A sensor 64 is positioned adjacent to the upstream conveyor 52. The sensor 64 is a light sensor, but weight, motion or other now known or later developed sensors may be used. The sensor 64 is positioned to detect a trailing corner of the towel 22 on the upstream conveyor 52. In one embodiment, the sensor 64 is a plurality of light sensors positioned on a platform beneath the straps of the upper run of the conveyor 52 so as to sense a towel 22 between the straps. By providing a sensor array, the trailing corner of the towel 22 is detected as well as a position of the trailing corner perpendicular to the direction of travel of the conveyor 52. In alternative embodiments, the sensors 64 are positioned above the conveyor 52 or are positioned to detect the towel 22 on the conveyor 58 or in the slot 62. When the trailing corner of the towel 22 is detected, such as the last portion of the towel being conveyed off of the last sensor of the array 64 as shown in FIG. 6, the conveyors 52 and 58 are slowed. For example, the conveyors 52 and 58 are stopped. The sensor 64 is spaced from an end of the conveyor 52 such that when the conveyors 52, 58 stop, the towel 22 is positioned on both conveyors. A majority of the towel 22 is positioned on the downstream conveyor 58 while only a trailing corner or a minority of the towel 22 is positioned on the upstream conveyor 52.

A movable clamp 60 is positioned within or adjacent to the slot 62. The clamp is of a same or different structure as the clamp 16 described above. The clamp 60 is connected to a drive mechanism, such as the same or different structure as the drive mechanism 20 described above. The clamp 60 is movable through a part, all or other length of the slot 62. The clamp 60 moves along the plane where the towel 22 is likely to be within the slot 62, such as the plane defined by the upper surfaces of the conveyors 52 and 58.

Figure 7:
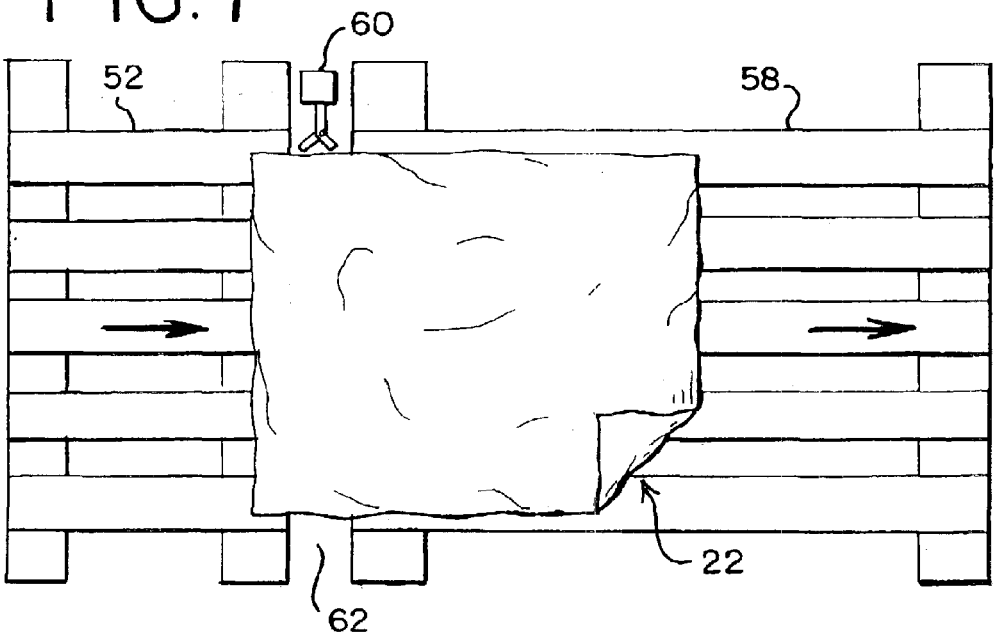
FIG. 7 is a top view of the conveyors of FIG. 6 with the towel in a second position.

The clamp 60 is responsive to the sensor 64. The clamp 64 is moved to a position detected as being the position of the trailing corner by the sensor 64. As a result, the clamp 60 contacts the towel 22. Since the towel 22 is substantially flat, the clamp 60 grabs an edge of the towel 22. After clamping the edge of the towel 22 between the two conveyors 52, 58 as shown in FIG. 6, the clamp 60 moves the clamped edge closer to a side of the upstream and downstream conveyors 52 and 58. As a result of moving the edge of the towel 22 closer to a side of the conveyors, another edge of the towel 22 is more likely squared or made perpendicular to the direction of the travel of the upstream and downstream conveyors 52 and 58. FIG. 7 shows the position of the towel 22 after the clamp 60 moves an edge toward the side, making another edge more perpendicular to the direction of travel of the conveyors 52, 58. As a result, the trailing edge of the towel 22 is now straight or close to straight along a perpendicular direction to the direction of travel of the towel. As shown in FIGS. 6 and 7, one or more folds may occur in the towel 22. Alternatively, the towel is laid out flat without folds.

Once substantially squared, the towel 22 is conveyed downstream by moving the upper run of the conveyor 58. The conveyor 52 may also be actuated, but may remain in a stationary position in alternative embodiments.

Two or more jaw points 66 are positioned above the conveyor 58. The jaw points 66 are plastic, metal, wood, rubber or other now known or later developed materials connected with an actuator 70 in a pivot point. The jaw points 66 act as one end of a clamp. In alternative embodiments, the jaw points 66 comprise a plate or roller that may press against the conveyor 58 in at least the points, such as along a line, to act as a clamp. In alternative embodiments, the jaw points 66 comprise higher clamps operable to clamp the trailing edge or other portion of the towel 22 rather than using the conveyor 58 as one end of the jaw. By actuation of the actuator 70, the jaw points 62 are operable to press against the conveyor 58, pressing and clamping the towel 22 between the jaw points 66 and the conveyor 58. As shown in FIG. 3, the jaw points 66 are oriented such that the clamping position is at a roller 72. In one embodiment, the conveyor 58 includes a plurality of straps and the jaw point 66 are oriented to press against the roller 72 between the straps, such as at a stationary portion of the conveyor 58. A Teflon, plastic or other guard may be positioned around the roller 72 at the press point 66 to avoid friction engagement and wear on the jaw points 66 or roller 72. By providing two or more jaw points 66 spread across the conveyor as shown in FIG. 4, a trailing edge or portion of the towel 22 may be pressed or clamped against the conveyor 58.

A sensor 68 is directed towards the conveyor 58 adjacent to a point or location where the jaw points 66 arc operable to contact the conveyor 58. As shown in FIG. 3, the sensor 68 is positioned within the conveyor 58, such as on a platform below the upper run of the conveyor. In alternative embodiments, the sensor 68 is positioned away from the conveyor 58, such as below, above, or to the side of the conveyor 58. While one sensor is shown, an array of sensors may be used. The sensor 68 is a light sensor or other now known or later developed sensor for detecting the presence or absence of the towel 22. In response to the sensor 68 detecting the trailing edge of the towel 22, the conveyor 58 is stopped or continues movement. Alternatively, the conveyor 58 continues to operate. Also in response to the detection of the trailing edge, the jaw points 66 are actuated to press the towel 22 against the conveyor 58, causing the towel 22 to cease forward movement. As a result, conveyance of the towel 22 is stopped. The conveyor 58 is slowed or stopped in response to detection of the trailing edge and during the pressing or clamping of the towel 22 by the jaw points 66. Alternatively, the conveyor 58 is speed up or maintains a same speed. The conveyor 58 may change speed in response to the operation of the clamp 60 in the slot 62 and not in response to the clamping by the jaw points 66.

An exit conveyor 74 is disposed downstream from the center conveyor 58. The exit conveyor 74 comprises a same or different structure as the conveyor 52. The exit conveyor 74 is of a similar length to the conveyor 58, but may be longer or shorter. While the term exit is used to describe the conveyor 74, additional or further conveyors may be provided for conveying the towel 22 from the separator. The exit conveyor 74 is positioned downstream from the center conveyor 58 and has a top surface below the top surface of the center conveyor 58. In one embodiment, the top surface of the exit conveyor 54 is below the roller 72. Since the conveyor 58 may be angled downward or upward, and the exit conveyor 74 may also be angled downwards or upwards, the relative positions of the top surfaces described herein is at the roller 72 of the center conveyor 58 and at the roller 76 of the exit conveyor 74 or at the point closest between the center conveyor 58 and the exit conveyor 74. As shown in FIG. 3, the center conveyor 58 overlaps the exit conveyor 74. In alternative embodiments, the exit conveyor 74 is spaced further from or closer to the center conveyor 58 in either horizontal and/or vertical directions. In one embodiment, the exit conveyor 74 conveys the towel 22 in a same direction as the center conveyor 58 so that an end of the center conveyor 58 is adjacent to a beginning of the exit conveyor 74.

As the towel 22 is conveyed off of the center conveyor 58, the towel 22 contacts the exit conveyor 74 and is conveyed away from the center conveyor 58. In one embodiment, the conveyor 74 operates at a slightly faster speed than the conveyor 58 to avoid wrinkling the towel 22. In alternative embodiments, the center conveyor 58 is faster or a same speed as the exit conveyor 74.

The exit conveyor 74 is operable to continue movement while a portion, such as the leading portion or majority of the towel 22 is on the exit conveyor 74 even while the jaw points 66 clamp the trailing edge of the towel 22. By positioning the towel 22 on both the center conveyor 58 and the exit conveyor 74 and clamping the trailing edge of the towel 22, any folds in the towel may be removed. By continuing to convey the exit conveyor 74 while the trailing edge is clamped, any folds in the towel 22 are pulled out by the exit conveyor 74. For example, where a corner of the towel is folded under the majority of the towel 22, the movement of the conveyor 74 while the trailing edge of the towel 22 is clamped forces the folded under corner to extend out flat or unfold.

One or more blowers 78 are positioned to direct air or other gas towards the exit conveyor 74. The blowers 78 are valves or other now known or later developed devices connected with a source of pressurized gas for directing a burst of forced air towards the exit conveyor 74. As shown in FIGS. 3 and 4, two blowers 78 are positioned above into each side of the exit conveyor 74. The blowers are directed towards the towel 22. In alternative embodiments, the blowers 78 are positioned below the conveyor 74 to direct air through the conveyor 74, are positioned between the center conveyor 58 and the exit conveyor 74, or are positioned to the sides on a same plane with the exit conveyor 74. Other positions and numbers of blowers 78 at one or more of those positions may be used. The blowers 78 direct air towards the towel 22 while the towel 22 is positioned on the exit conveyor 74 and the trailing edge of the towel 22 is clamped by the jaw points 66. By blowing the towel 22 while the trailing edge is clamped, any folds in the towel are flattened out. For example, the forced air assists in flattening out folds underneath the majority of the towel 22. As another example, the blast of air causes folds in the towel above the majority of the towel to flatten out. As a result of the continuing movement of the exit conveyor 74 and the blowing while the trailing edge of the towel 22 is held in position, the towel 22 is more likely laid out flat. In an alternative embodiment, the air is directed at a likely center location of the towel 22 so that as the air contacts the towel and spreads outward from the center point, any folds are extended outward. As a result the towel is laid flat.

After the blowing is complete, the jaw points 66 are raised, releasing the clamp on the trailing edge of the towel 22. The exit conveyor 74 continues to convey the towel 22 towards an exit of the spreader. As a result, the trailing edge of the towel 22 is conveyed off of the center conveyor 58 and downstream on the exit conveyor 74. At this point, the towel 22 is likely laid out flat and square. For example, two edges of the towel 22 are parallel to the direction of movement and two edges are perpendicular to the direction of movement without any folds in the towel 22. The towel 22 is then provided to an operator or other automated machine, such as an automatic folder.

While the invention has been disclosed above by reference to various embodiments, it should be understood that many changes and modifications can be made without departing from the scope of the invention. For example, any number of additional stages may be provided. Different clamp, conveyor, sensor, actuator drive structures may be used, including now known or later developed structures.

It is therefore intended that the foregoing detailed description be understood as an illustration of the presently preferred embodiment of the invention, and not as a definition of the invention. It is only the following claims, including all equivalents, that are intended to define the scope of this invention.

What is claimed is:

1. An apparatus for spreading an article of laundry from a load of articles of laundry, the apparatus comprising:

a frame;

a clamp operable to grab the article of laundry;

a pivot joint connected with the clamp and the frame; and a drive connected with the clamp, the drive connected so as to drive the clamp downward about the pivot joint;

wherein at least a portion of the article of laundry is forced away from the clamp in response to the clamp being driven.

2. The apparatus of claim 1 wherein an area below at least a portion of the travel of the clamp is free of obstructions such that the article of laundry extends away from the clamp as a result of the clamp being driven downward.

3. The apparatus of claim 1 wherein the clamp comprises at least two clamps positioned to grab the article of laundry at two locations, respectively.

4. The apparatus of claim 1 wherein the pivot joint is operable to allow rotation between 70 and 135 degrees.

5. The apparatus of claim 1 wherein the combination of gravity and movement of the clamp with the article of laundry is operable to extend the article of laundry outward from the clamp in a substantially flat position.

6. The apparatus of claim 1 further comprising a lift operable to position the article of laundry in a horizontal position adjacent the clamp, the clamp grabbing the article of laundry from the lift, the clamp operable to grab a random location on the article of laundry.

7. The apparatus of claim 1 further comprising a conveyor positioned below the pivot joint such that the clamp deposits the article of laundry on the conveyor after the clamp is driven downward.

8. A method for spreading an article of laundry from a load of articles of laundry, the method comprising:

(a) clamping a article of laundry;

(b) rotating the entire article of laundry about an axis spaced away from the article of laundry, the rotation being at least in part downward; and (c) flattening the article of laundry in response to force of the rotation.

9. The method of claim 8 further comprising:

(d) avoiding contact with the article of laundry during (b) such that the article of laundry extends away from a clamp as a result of the clamp being rotated.

10. The method of claim 8 wherein (b) comprises rotating the article of laundry 70 and 135 degrees.

11. The method of claim 8 wherein (b) comprises extending the article of laundry outward in a substantially flat position.

12. The method of claim 8 further comprising:

(d) lifting the article of laundry to a substantially horizontal position along a least a portion of the article of laundry;

wherein (a) comprises clamping the article of laundry while in the substantially horizontal position.

13. The method of claim 8 further comprising:

(d) releasing the article of laundry on a surface with the article of laundry in a flat position after the rotation of (b).

14. An apparatus for spreading a article of laundry from a load of articles of laundry, the apparatus comprising:

a first conveyor;

a second conveyor spaced from the first conveyor by a slot, the slot narrow such that the article of laundry is able to rest on both the first and second conveyors at a same time; and a clamp positioned to move in the slot between the first and second conveyors.

15. The apparatus of claim 14 further comprising a sensor adjacent the first conveyor, the sensor positioned to detect a trailing corner of the article of laundry on the first conveyor, the clamp responsive to the sensor.

16. The apparatus of claim 15 wherein the first conveyor is operable to cease conveying in response to the sensor such that the trailing corner is on the first conveyor and at least another portion of the article of laundry is on the second conveyor.

17. The apparatus of claim 14 wherein the clamp is operable to grab a first edge of the article of laundry and move the edge closer to one side of the second conveyor.

18. The apparatus of claim 17 wherein a second edge is positioned more perpendicular to a direction of travel of the second conveyor in response to the movement by the clamp.

19. The apparatus of claim 14 wherein the first and second conveyors are aligned to convey the article of laundry in a same direction at a same level.

20. A method for spreading an article of laundry from a load of articles of laundry, the method comprising:

(a) conveying a article of laundry on a first conveyor;

(b) conveying the article of laundry onto a second conveyor;

(c) clamping a first edge of the article of laundry between the first and second conveyors; and (d) moving the clamped first edge of the article of laundry closer to a side of the second conveyor such that a second edge of the article of laundry is more perpendicular to a direction of travel of the second conveyor.

21. The method of claim 20 further comprising:

(e) sensing a trailing portion of the article of laundry on the first conveyor; and (f) slowing conveyance of the first conveyor in response to the sensing of (c) and prior to performing (c) and (d).

22. The method of claim 20 wherein (a) and (b) convey the article of laundry in a substantially same direction.

23. An apparatus for spreading an article of laundry from a load of articles of laundry, the apparatus comprising:

a first conveyor;

a second conveyor disposed downstream from the first conveyor;

at least two jaw points positioned above the first conveyor and operable to press a first portion of the article of laundry against the first conveyor; and a blower directed towards the second conveyor;

wherein the second conveyor is operable to continue movement with a second portion of the article of laundry on the second conveyor and while the first portion of the article of laundry is held by the jaw points against the first conveyor; and wherein the blower is operable to direct air towards the article of laundry while the second portion of the article of laundry is on the second conveyor and the first portion of the article of laundry is held by the jaw points against the first conveyor.

24. The apparatus of claim 23 wherein the first conveyor and second conveyor convey in a same direction, the second conveyor having a second top surface lower than a first top surface of the first conveyor, the first top surface at an end of the first conveyor and the second top surface at a beginning of the second conveyor.

25. The apparatus of claim 23 further comprising a sensor directed towards the first conveyor adjacent to a point where the jaw points are operable to contact the first conveyor.

26. The apparatus of claim 23 wherein the blower comprises a plurality of blowers directed towards the second conveyor from different directions.

27. The apparatus of claim 23 wherein the at least two jaw points are operable to lift from the first conveyor such that the article of laundry is conveyed by the second conveyor off of the first conveyor.

28. A method for spreading an article of laundry from a load of articles of laundry, the method comprising:

(a) positioning the article of laundry on both first and second conveyors, the second conveyor downstream from the first conveyor;

(b) clamping the article of laundry with a first portion of the article of laundry on the first conveyor;

(c) continuing to convey with the second conveyor while the article of laundry is clamped; and (d) blowing at a second portion of the article of laundry while the article of laundry is clamped, the second portion on the second conveyor.

29. The method of claim 28 wherein (b) comprises pressing at least two points of a trailing edge of the article of laundry against the first conveyor.

30. The method of claim 28 further comprising:

(e) sensing a trailing edge of the article of laundry on the first conveyor; wherein (b) is performed in response to (e).

31. The method of claim 28 wherein (d) comprises blowing the second portion from a plurality of directions.

32. The method of claim 28 further comprising:

(e) releasing the clamping of (b); and (f) conveying the article of laundry off of the first conveyor and downstream on the second conveyor.

33. An apparatus for spreading an article of laundry from a load of articles of laundry, the apparatus comprising:

a frame;

a first clamp operable to grab the article of laundry;

a pivot joint connected with the clamp and the frame;

a drive connected with the clamp, the drive connected so as to drive the clamp downward about the pivot joint, the driving operable to force at least a portion of the article of laundry away from the clamp;

a first conveyor positioned below the clamp and operable to receive the article of laundry from the first clamp;

a second conveyor spaced from the first conveyor by a slot, the slot narrow such that the article of laundry is able to rest on both the first and second conveyors at a same time;

a second clamp positioned to move in the slot between the first and second conveyors and adjacent a top portion of the first and second conveyors, the second clamp operable to square the article of laundry to a direction of travel on the second conveyor in response to clamping and moving a first edge of the article of laundry closer to a side of the second conveyor;

a third conveyor disposed downstream from the second conveyor;

at least two jaw points positioned above the second conveyor and operable to press a trailing portion of the article of laundry against the second conveyor; and a blower directed towards the third conveyor;

wherein the third conveyor is operable to continue movement with a leading portion of the article of laundry on the third conveyor and while the trailing portion of the article of laundry is held by the jaw points against the second conveyor; and wherein the blower directs air towards the article of laundry while the leading portion of the article of laundry is on the third conveyor and the trailing portion of the article of laundry is held by the jaw points against the second conveyor.

* * * * *